US012799697B2

(12) United States Patent
Hakky

(10) Patent No.: US 12,799,697 B2
(45) Date of Patent: Nov. 17, 2026

(54) MOBILE SNOW PROCESSING AND DE-ICING DEVICE AND METHOD

(71) Applicant: SNOWGO LLC, Gainesville, VA (US)

(72) Inventor: Said Ismail Hakky, Gainesville, VA (US)

( * ) Notice: Subject to any disclaimer, the term of this patent is extended or adjusted under 35 U.S.C. 154(b) by 225 days.

(21) Appl. No.: 18/839,983

(22) PCT Filed: Jan. 26, 2024

(86) PCT No.: PCT/US2024/013170
§ 371 (c)(1),
(2) Date: Aug. 20, 2024

(87) PCT Pub. No.: WO2024/163293
PCT Pub. Date: Aug. 8, 2024

(65) Prior Publication Data

US 2025/0230619 A1 Jul. 17, 2025

Related U.S. Application Data

(60) Provisional application No. 63/482,108, filed on Jan. 30, 2023.

(51) Int. Cl.
*E01H 5/10* (2006.01)
*E01H 10/00* (2006.01)

(52) U.S. Cl.
CPC ..... *E01H 10/007* (2013.01); *E01H 5/104* (2013.01)

(58) Field of Classification Search
CPC ..... E01H 5/104; E01H 10/007
See application file for complete search history.

(56) References Cited

U.S. PATENT DOCUMENTS 3,766,586 A * 10/1973 Krickovich ..... E01H 1/0845 15/83
4,164,820 A * 8/1979 Krickovich ..... E01H 5/104 15/340.3
6,305,105 B1 * 10/2001 Lowman ..... E01H 5/104 37/228

FOREIGN PATENT DOCUMENTS

CN 107354905 A * 11/2017 ..... E01H 5/104
KR 101152824 B1 * 6/2012 ..... E01H 10/007

* cited by examiner

*Primary Examiner* — Matthew R Buck
(74) *Attorney, Agent, or Firm* — Rosenberg, Klein & Lee

(57) ABSTRACT

A mobile snow processing and de-icing machine and method is disclosed. The device comprises a collecting unit featuring cylindrical and circular brushes to effectively scrape and remove snow from surfaces. Turbo-suction sweepers, driven by Turbo-suction motors adapted to clear the scraped off snow through a collecting tube. A de-icing unit employs a heated metal grid at an inlet of a de-icing tank, converting collected snow into slush. Connected to the collecting tube's output, the de-icing tank further mixes the slush with a prestored de-icing solution, preparing a diluted deicing solution. The device further provides a sprinkler unit linked to an outlet of the de-icing tank, allowing a controlled spraying of the diluted de-icing solution back onto surfaces. This comprehensive mobile solution ensures efficient snow removal and proactive prevention of snow formation.

20 Claims, 12 Drawing Sheets

MOBILE SNOW PROCESSING AND DE-ICING DEVICE AND METHOD

CROSS-REFERENCE TO RELATED APPLICATION

This application claims the benefit of U.S. Provisional Application Ser. No. 63/482,108, filed Jan. 30, 2023, entitled "MOBILE SNOW PROCESSOR AND DE-ICER MACHINE", which is incorporated hereby for your reference in its entirety.

BACKGROUND

Field of Invention

Embodiments of the present invention disclosed herein relate, in general, to a de-icing device and, more particularly, to a mobile snow processing and de-icing device and method.

Description of Related Art

Conventional snow removal and de-icing devices and methods have relied on a variety of tools and technologies, each possessing its own set of limitations. In the field of snow removal, snow blowers, plows, and snow shovels have been the primary tools of choice. Snow blowers, while effective for lighter snowfall, often struggle with wet and heavy snow, requiring multiple passes and increased energy consumption.

Plows, typically mounted on trucks, are commonly used for clearing roads and larger areas. However, operators face challenges while using the plows in maneuverability and precision, particularly in tight spaces or areas with obstacles. Moreover, the effectiveness of the plows is contingent upon the skill of the operators, and their inability to address localized snow accumulation, which hinders their utility in certain scenarios. Finally, plowing and piling snow into large mounds or hills of ice is not a very effective solution for managing fallen snow.

Conventional de-icing systems, on the other hand, have been used by dedicated de-icing vehicles such as, not limited to, trucks or salt spreaders. These vehicles apply de-icing agents such as salt or liquid brine to road surfaces to mitigate ice formation. The conventional systems operate independently to remove snow and are somewhat effective in preventing icy conditions, however, the operators require separate equipment for the maintenance in comprehensive winters.

Conventionally, snow removal and de-icing functions were integrated for ease of use of the operators. However, the integrated systems often compromise on efficiency or maneuverability. For instance, some integrated systems can sacrifice snow removal capabilities for a more robust de-icing system, leading to suboptimal results in areas with heavy snow accumulation.

Furthermore, environmental concerns have emerged regarding the use of traditional de-icing agents, such as rock salt, ferric compounds, and magnesium compounds, due to their impact on soil and water quality. This has prompted a need for innovations that consider the ecological implications of snow and ice management.

Thus, there is a need for a mobile snow processing and de-icing device and method that can administer the aforementioned limitations in a more efficient manner, such as, for example, processing the snow back to a liquid or semi-liquid de-iced state and recycling the de-iced liquid, with one or more additives, for distribution.

SUMMARY

One embodiment provides a mobile snow processing and de-icing device. The device comprises a collecting unit. The collecting unit comprises one or more cylindrical brushes to scrape off snow from a surface; a plurality of circular brushes rotatable perpendicular to the surface adapted to scrape off the snow, wherein the plurality of circular brushes are attached on the sides of the one or more cylindrical brushes; and at least one turbo-suction sweeper configured to sweep the scraped off snow from the surface using one or more turbo-suction motors through at least one collecting tube. The device further comprises a de-icing unit. The de-icing unit comprises a heated metal grid arranged at an inlet of at least one de-icing tank to convert the collected snow into a slush; and at least one de-icing tank, connected at an output end of the at least one collecting tube, to receive the slush and further mix the received slush with a prestored de-icing solution to prepare a diluted de-icing solution within the at least one de-icing tank. The device further comprises a sprinkler unit. The sprinkler unit comprises at least one sprinkler system, connected to an outlet of the at least one de-icing tank, configured to spray the diluted de-icing solution from the at least one de-icing tank back on the surface.

Another embodiment provides a mobile snow processing and de-icing device. The device comprises a collecting unit. The collecting unit comprises one or more cylindrical brushes to scrape off snow from a surface; a plurality of circular brushes rotatable perpendicular to the surface adapted to scrape off the snow, wherein the plurality of circular brushes are attached on the sides of the one or more cylindrical brushes; and at least one turbo-suction sweeper configured to sweep the scraped off snow from the surface using one or more turbo-suction motors through at least one collecting tube. The device further comprises a de-icing unit. The de-icing unit comprises a heated metal grid arranged at an inlet of at least one de-icing tank to convert the collected snow into a slush; and at least one de-icing tank, connected at an output end of the at least one collecting tube, to receive the slush and further mix the received slush with a prestored de-icing solution to prepare a diluted de-icing solution within the at least one de-icing tank. The device further comprises a sprinkler unit. The sprinkler unit comprises at least one sprinkler system, connected to an outlet of the at least one de-icing tank, configured to spray the diluted de-icing solution from the at least one de-icing tank back on the surface; and at least one storage tank to store a concentrated de-icing solution to ensure a proper concentration of the diluted de-icing solution within the at least one de-icing tank.

A further embodiments provides a method for processing snow and de-icing using a mobile device. The method comprising steps of scraping off snow from a surface using one or more cylindrical brushes and a plurality of circular brushes attached perpendicular on the device to the surface; sweeping the scraped off snow from the surface using at least one turbo-suction sweeper equipped with one or more turbo-suction motors and at least one collecting tube; converting the collected snow into a slush by using at least one heated metal grid; mixing the slush with a prestored de-icing solution to produce a diluted de-icing solution; and spraying the diluted de-icing solution back onto the surface.

Additional embodiments may provide a mobile snow processing and de-icing device that provides a dual functionality such as a first functionality of a de-icing, and a second functionality of a snow removal.

Additional embodiments may provide a mobile snow processing and de-icing device that has enhanced mobility, as it may access tight and corner spaces.

Additional embodiments may provide a mobile snow processing and de-icing device that features autonomous functionality, as a set of sensors work in cohesion to reduce human labor and intervention.

Additional embodiments may provide a mobile snow processing and de-icing device that is versatile across snow types.

Additional embodiments may provide a mobile snow processing and de-icing device that is precise in de-icing and prevents further accumulation and freezing of snow over clear surfaces.

Additional embodiments may provide a mobile snow processing and de-icing device that reduces environmental impact by utilizing eco-friendly chemicals for de-icing of snow.

Additional embodiments may provide a mobile snow processing and de-icing device that saves time and is efficient when compared to conventional approaches.

Additional embodiments may provide a mobile snow processing and de-icing device that is adaptable to urban settlements and civilizations.

Additional embodiments may provide a mobile snow processing and de-icing device that is cost-effective and cost-efficient.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of embodiments in a simplified form as an introduction to the more detailed description presented below. As will be appreciated, other embodiments are possible, utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown embodiments presently preferred in the drawings, it being understood, however, the embodiments disclosed herein are not limited to the specific instrumentalities disclosed. Included in the drawings are the following figures.

Figure 1:
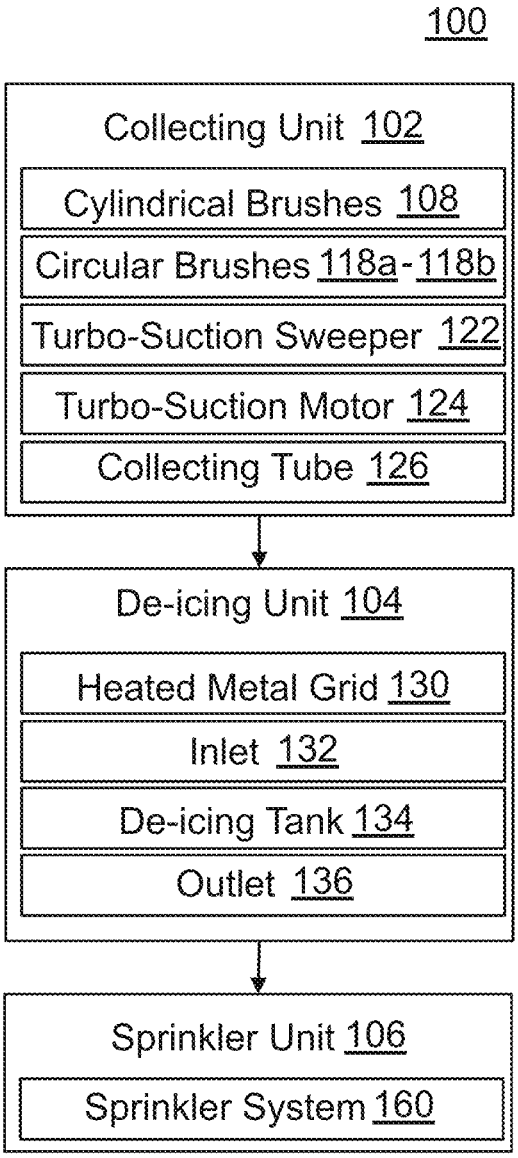
FIG. 1 illustrates a block diagram of a mobile snow processing and de-icing device, according to embodiments of the present invention disclosed herein.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modifications, equivalents, and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention will be described below in conjunction with exemplary mobile snow processing and de-icing machines, devices and methods. Embodiments of the present invention are not limited to any particular type of mobile snow processing and de-icing device or method. Those skilled in the art will recognize the disclosed techniques may be used in any mobile snow processing and de-icing device in which it is desirable to provide an interim mobile snow processing and de-icing device and method.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B, and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

The terms "determine", "calculate" and "compute", and variations thereof, as used herein, are used interchangeably and include any type of methodology, process, mathematical operation, or technique.

FIG. 1 illustrates a block diagram of a mobile snow processing and de-icing device 100 (hereinafter referred to as the device 100), according to embodiments of the present invention disclosed herein. In an embodiment of the present invention, the device 100 may be adapted to scrape off and collect snow or ice accumulated on surfaces. The surfaces may be, for example, but not limited to, roads, highways, freeways, airport runways, sidewalks, driveways, alleys, and narrower areas after a snowfall. Embodiments of the present invention are intended to include or otherwise cover any surface on which an accumulation of the snow occurs, including known, related art, and/or later developed technologies.

The device 100 may further spray a chemical solution after removal of the snow to prevent re-accumulation of black ice, and may further provide a delay in the freezing of the snow on a cleared surface i.e., the surface from which the snow is removed.

Figure 2A:
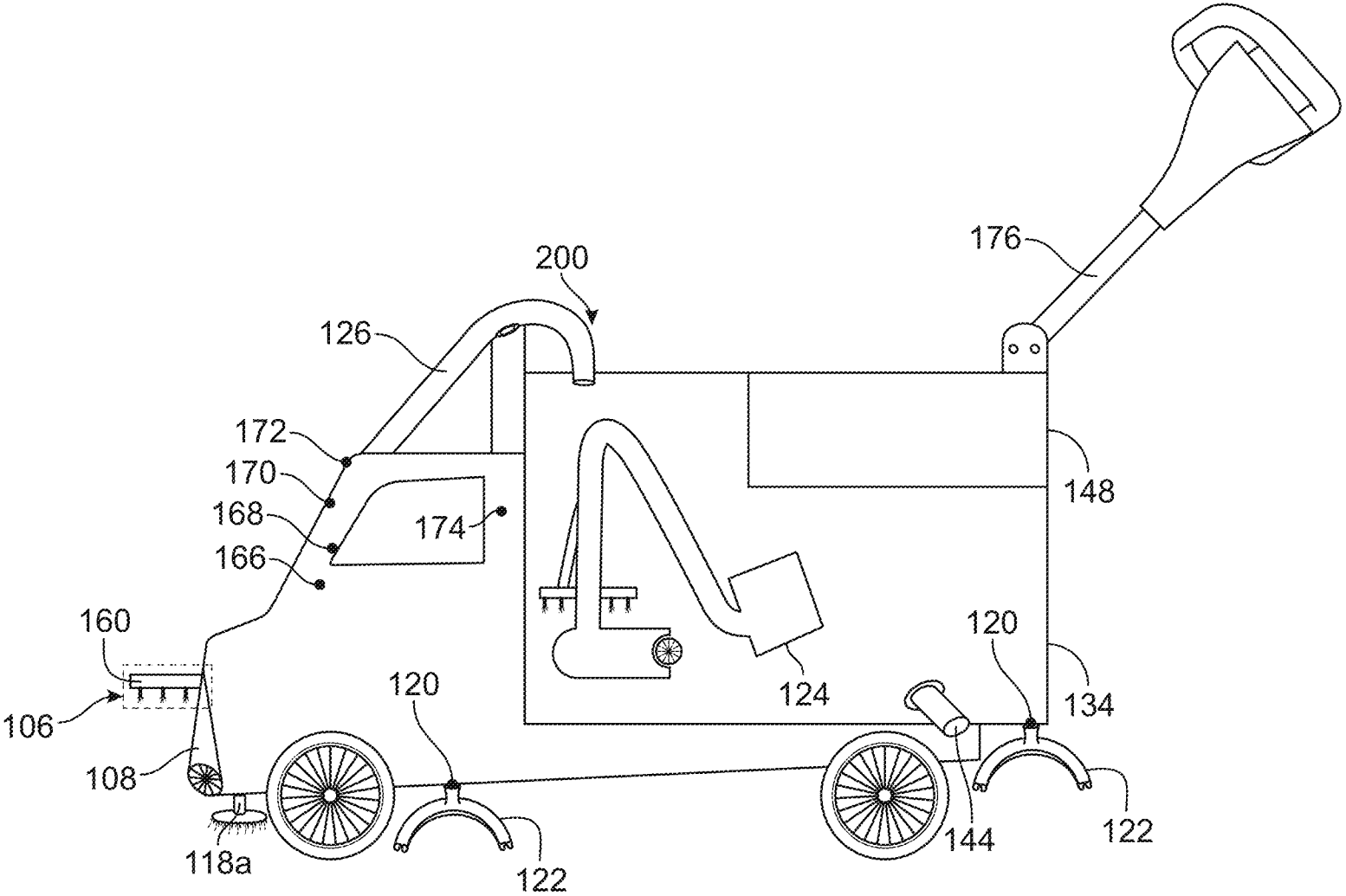
FIG. 2A illustrates an installation of the mobile snow processing and de-icing device on a vehicle, according to embodiments of the present invention disclosed herein.

In an embodiment of the present invention, the device 100 may be built in a vehicle 200 (as shown in FIG. 2A) that may be driven on the roads covered with the snow. The device 100 may further be established in a back bed of the vehicle 200. In another embodiment of the present invention, the device 100 may be a hand-driven mover. In yet another embodiment of the present invention, the device 100 may be a set of back wearable apparatus with a handheld apparatus and may be adapted to clear off the narrower areas after the snowfall. In yet another embodiment of the present invention, a battery-operated miniature version of the device 100 may be designed for smaller areas with a reduced operating potential.

According to embodiments of the present invention, the device 100 may comprise a collecting unit 102, a de-icing unit 104, and a sprinkler unit 106.

In an embodiment of the present invention, the collecting unit 102 may be arranged at a frontal location of the device 100. In another embodiment of the present invention, the collecting unit 102 may be arranged at a side location of the device 100. In yet another embodiment of the present invention, the collecting unit 102 may be arranged on a back location of the device 100.

In an embodiment of the present invention, the collecting unit 102 may be rigidly attached to the device 100. In another embodiment of the present invention, the collecting unit 102 may be removably attached (detachable) to the device 100.

According to embodiments of the present invention, the collecting unit 102 may comprise one or more cylindrical brushes 108 (hereinafter interchangeably used as 'a cylindrical brush 108' or 'the cylindrical brushes 108'), a plurality of circular brushes 118*a*-118*b*, at least one turbo-suction sweeper 122, at least one turbo-suction motor 124, and at least one collecting tube 126.

In an embodiment of the present invention, the cylindrical brushes 108 may be adapted to scrape off snow from the surface. The cylindrical brush 108 is explained in detail in conjunction with FIG. 3A.

Further, the plurality of the circular brushes 118*a*-118*b* may be adapted to scrape off the snow from the surface in a circular motion. In an embodiment of the present invention, the plurality of the circular brushes 118*a*-118*b* may be adapted to rotate perpendicular to the surface and may be adapted to scrape off the snow from the surface. The plurality of the circular brushes 118*a*-118*b* may be attached on the sides of the cylindrical brushes 108, in an embodiment of the present invention. In another embodiment of the present invention, the plurality of the circular brushes 118*a*-118*b* may be attached adjacent to the cylindrical brushes 108. The plurality of the circular brushes 118*a*-118*b* may further be attached forward and backward to the cylindrical brushes 108, in another embodiment of the present invention. The circular brushes 118*a*-118*b* may further be explained in detail in conjunction with FIG. 4.

In a preferred embodiment of the present invention, one cylindrical brush 108 and two circular brushes 118*a*-118*b* are illustrated to be installed in the collecting unit 102. However, any number of the cylindrical brush 108 and the circular brushes 118*a*-118*b* may be installed in the collecting unit 102.

In an embodiment of the present invention, the turbo-suction sweeper 122 may be configured to sweep the scraped off snow from the surface using the turbo-suction motor 124 through the collecting tube 126. In an embodiment of the present invention, the turbo-suction sweeper 122 may be installed in the device 100 at locations such as, but not limited to, a right side of the device 100, a left side of the device 100, a front side of the device 100, underneath of the device 100, and so forth. In a preferred embodiment of the present invention, the turbo-suction sweeper 122 may be installed at a back side of the device 100. Embodiments of the present invention are intended to include or otherwise cover any location for the installation of turbo-suction sweeper 122 into the device 100.

Additionally, the turbo-suction sweeper 122 may be arranged in the rear of the cylindrical brush 108 and circular brushes 118*a*-118*b* to easily sweep off the scraped off snow by the cylindrical brush 108 and circular brushes 118*a*-118*b*, in an embodiment of the present invention. The turbo-suction sweeper 122 may further pull in the scraped off snow using the turbo-suction motor 124 into the collecting tube 126.

In an embodiment of the present invention, the turbo-suction motor 124 may further be adapted to adjust a sweeping intensity of the turbo-suction sweeper 122 based on a density of the collected snow. In an exemplary embodiment, if the swiped off snow on the surface may be in a higher density, then the sweeping intensity of the turbo-suction motor 124 may be adjusted to a high setting.

However, if the swiped off snow on the surface may be in a lower density, then the sweeping intensity of the turbo-suction motor 124 may be adjusted to a medium to low setting. The turbo-suction motor 124 may be, for example, but not limited to, an alternating current motor, a Brushless Direct Current (BLDC) motor, a submersible motor, and so forth. Embodiments of the present invention are intended to include or otherwise cover any type of the turbo-suction motor 124, including known, related art, and/or later developed technologies.

Figure 5:
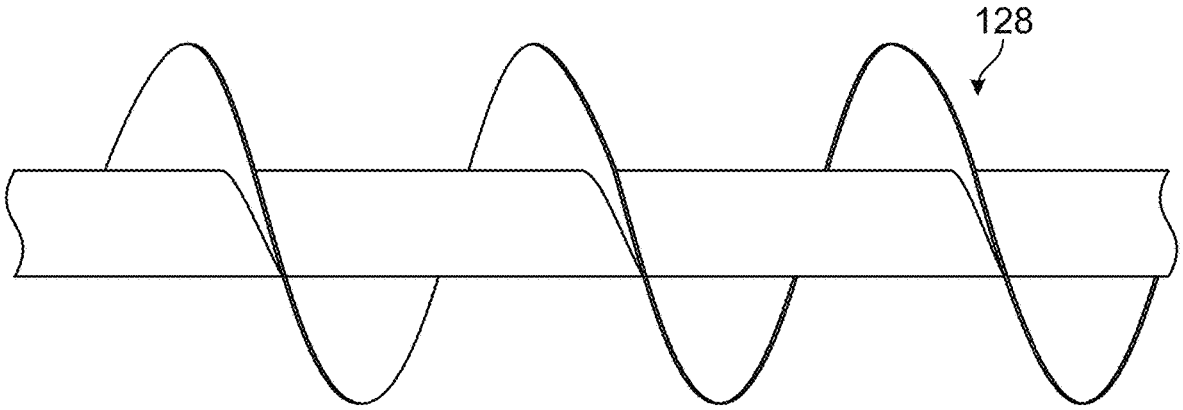
FIG. 5 illustrates a helical screw of the mobile snow processing and de-icing device, according to embodiments of the present invention disclosed herein.

Further, the collecting tube 126 may comprise a helical screw 128 (as shown in FIG. 5) that may be arranged inside of the collecting tube 126, in an embodiment of the present invention. The function of the helical screw 128 is to direct the scraped off snow pulled by the turbo-suction sweeper 122 into the de-icing unit 104. The mechanical rotation of the helical screw 128 within the collecting tube 126 may generate some heat that may be used to melt the snow into a slush, in an embodiment of the present invention.

Figure 6:
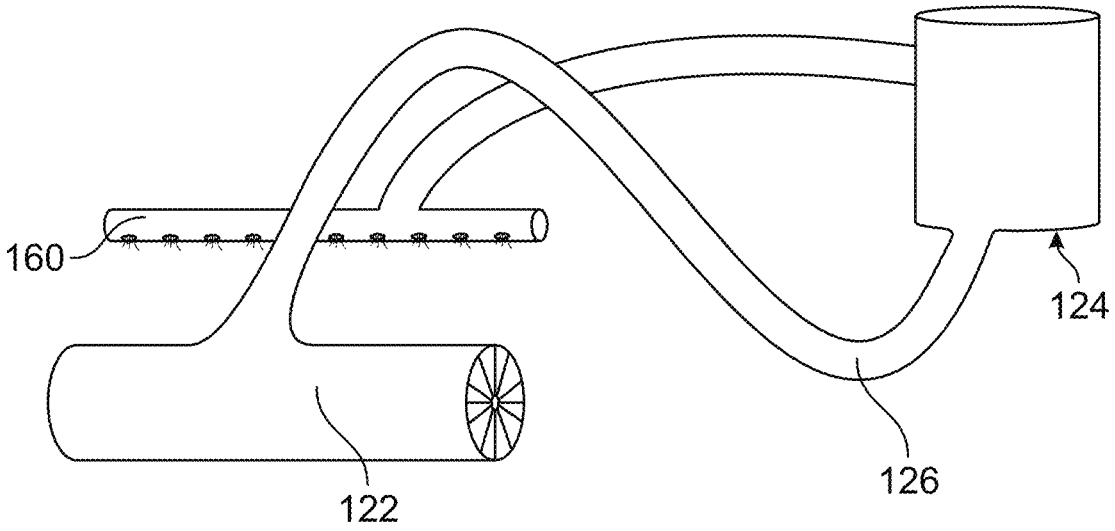
FIG. 6 illustrates a connectivity of a turbo-suction sweeper and a turbo-suction motor through a collecting tube of the mobile snow processing and de-icing device, according to embodiments of the present invention disclosed herein.

In an embodiment of the present invention, the connectivity of the turbo-suction sweeper 122 and the turbo-suction motor 124 through the collecting tube 126 is further explained in conjunction with FIG. 6.

In a preferred embodiment of the present invention, a single turbo-suction sweeper 122 is illustrated to be installed in configuration of a single turbo-suction motor 124 through a single collecting tube 126. However, any number of the turbo-suction sweeper 122 may be installed in configuration with any number of the turbo-suction motor 124 through any number of collecting tubes 126.

Further, the de-icing unit 104 may comprise a heated metal grid 130, an inlet 132, a de-icing tank 134, and an outlet 136 of the de-icing tank 134, in an embodiment of the present invention.

In an embodiment of the present invention, the heated metal grid 130 may be arranged at the inlet 132 of the de-icing tank 134 to convert the collected snow into a slush. The heated metal grid 130 may be adapted to be electrically heated, in an embodiment of the present invention. Upon electrical heating of the heated metal grid 130, the collected snow coming in contact with the heated metal grid 130 may tend to change a state from a solid state to a semi-solid state or in liquid state, hence converting the collected snow to the slush and/or water.

In an embodiment of the present invention, the de-icing tank 134 may be connected at an output end of the collecting tube 126. The de-icing tank 134 may be adapted to receive the slush from the collecting tube 126. Further, the de-icing tank 134 may pre-store de-icing solution, in an embodiment of the present invention. The prestored de-icing solution may be, for example, but not limited to, a brine solution, glycerol, peony leaves, stalks, a beetroot solution 20/80 (v/v), and so forth. Embodiments of the present invention are intended to include or otherwise cover any prestored de-icing solution, including known, related art, and/or later developed technologies.

Further, the slush received from the collecting tube 126 in the de-icing tank 134 may be mixed with the prestored de-icing solution to prepare a diluted de-icing solution within the de-icing tank 134. In an embodiment of the present invention, the de-icing tank 134 is further explained in detail in conjunction with FIG. 7.

Further, the device 100 may comprise the sprinkler unit 106, as discussed above. According to embodiments of the present invention, the sprinkler unit 106 may comprise a sprinkler system 160.

In an embodiment of the present invention, the sprinkler system 160 may be connected to the outlet 136 of the de-icing tank 134. The sprinkler system 160 may be configured to spray the diluted de-icing solution from the de-icing tank 134 back on the surface to prevent formation of black snow on the surface. The sprinkler system 160 is further explained in detail in conjunction with FIG. 7.

FIG. 2A illustrates an installation of the device 100 on the vehicle 200, according to embodiments of the present invention disclosed herein.

In an embodiment of the present invention, the cylindrical brush 108 and the circular brushes 118*a*-118*b* may be arranged at the frontal location of the vehicle 200. The cylindrical brush 108 and the circular brushes 118*a*-118*b* may be adapted to scrape off the snow from the surface.

In an embodiment of the present invention, an actuator 120 may be configured to control a speed of rotation of the cylindrical brush 108 and the circular brushes 118*a*-118*b*. Further, the actuator 120 may rotate the cylindrical brush 108 and the circular brushes 118*a*-118*b* at a same speed, in an embodiment of the present invention. The actuator 120 may further rotate the cylindrical brush 108 and the circular brushes 118*a*-118*b* at the different speeds, in another embodiment of the present invention.

The speed of rotation of the cylindrical brush 108 and the circular brushes 118*a*-118*b* may be controlled by an operator. The operator may control the speed of rotation of the cylindrical brush 108 and the circular brushes 118*a*-118*b* based upon factors such as, but not limited to, a rigidity of the snow on the road, a rate of snowfall on the road, and so forth. Embodiments of the present invention are intended to include or otherwise cover any other factors for controlling the speed of rotation of the cylindrical brush 108 and the circular brushes 118*a*-118*b*, including known, related art, and/or later developed technologies that may be beneficial to scrape off the snow from the surfaces.

The actuator 120 may further be configured to control the speed of rotation of the cylindrical brush 108 and the circular brushes 118*a*-118*b* based on a rate of the snow accumulation on the roads. In an embodiment of the present invention, the speed of rotation of the cylindrical brush 108 and the circular brushes 118*a*-118*b* may be controlled by the actuator 120 in three different speeds such as a high speed, a medium speed, and a low speed. In another embodiment of the present invention, the speed of rotation of the cylindrical brush 108 and the circular brushes 118*a*-118*b* may be controlled by the actuator 120 in two different speeds such as, a fast speed and a slow speed.

In another embodiment of the present invention, the speed of rotation of the cylindrical brush 108 and the circular brushes 118*a*-118*b* may be operated and controlled in coordination with a camera (not shown) by a controller 166.

In an embodiment of the present invention, the scraped off snow on the surface may be bought in proximity to a sweeping mouth of the turbo-suction sweeper 122. As the device 100 may be moved or maneuvered, the scraped off snow may come close to the turbo-suction sweeper 122. Otherwise, the sweeping mouth of the turbo-suction sweeper 122 may be bought near the scraped off snow for sweeping the snow in the collecting tube 126.

The turbo-suction motor 124 may be connected to the turbo-suction sweeper 122 through the collecting tube 126 and may facilitate a movement of the snow into the de-icing tank 134. The collected snow may be deposited in the de-icing tank 134, in an embodiment of the present invention.

The de-icing tank 134 may be equipped to receive the slush that may be created by partial melting of the collected snow using the heated metal grid 130, as discussed in the FIG. 1. Further, the slush received from the collecting tube 126 via the heated metal grid 130 may be mixed with the pre-stored de-icing solution within the de-icing tank 134 to prepare the diluted de-icing solution.

In an embodiment of the present invention, the de-icing tank 134 may be arranged at a back side of the device 100. In another embodiment of the present invention, the de-icing tank 134 may be arranged under the device 100. In an embodiment of the present invention, the de-icing tank 134 is further explained in detail in conjunction with FIG. 7.

In an embodiment of the present invention, a storage tank 148 may be adapted to store a concentrated de-icing solution to ensure proper concentration of the prestored de-icing solution and/or the diluted de-icing solution within the de-icing tank 134. In an embodiment of the present invention, the storage tank 148 may be arranged on a top of the de-icing tank 134.

Figure 7:
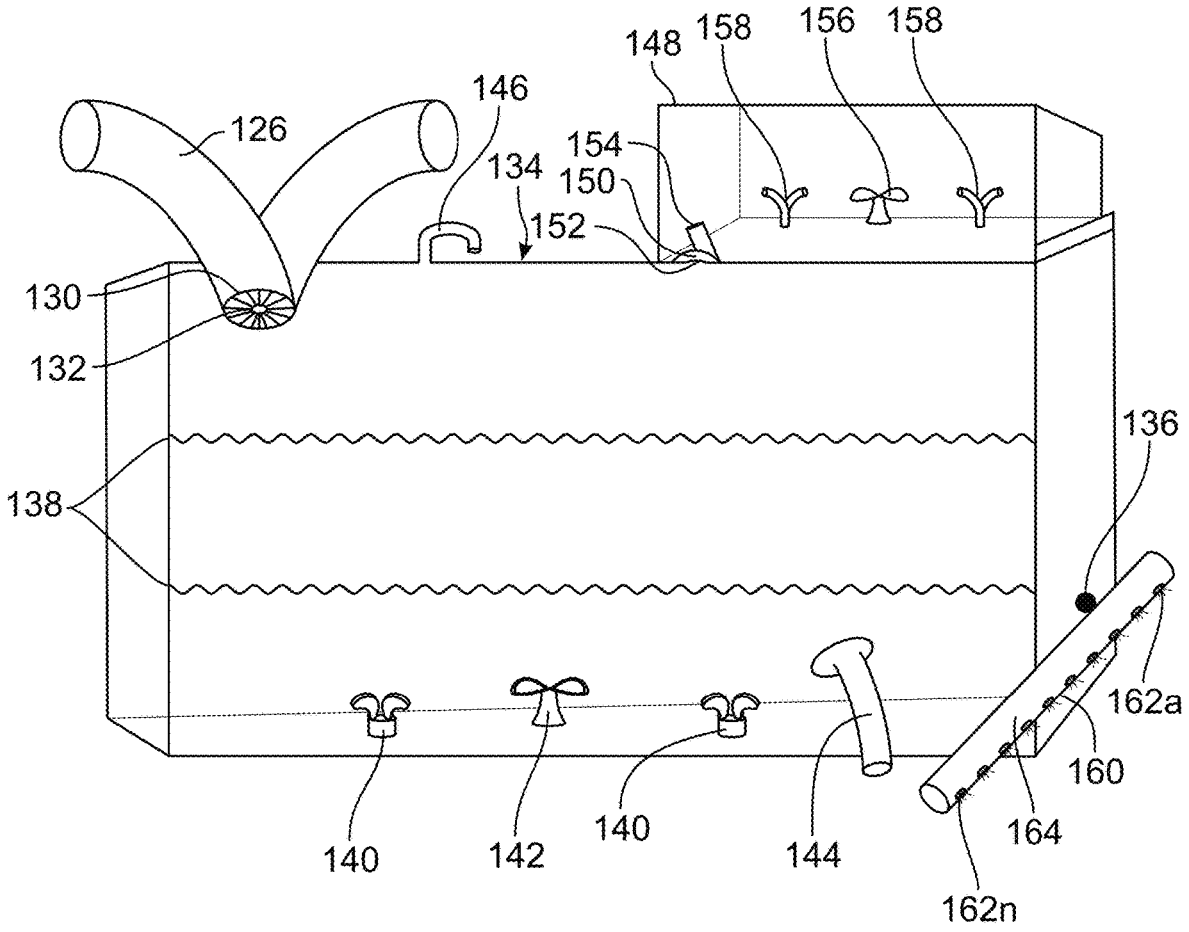
FIG. 7 illustrates a diagram of a de-icing tank of the mobile snow processing and de-icing device, according to embodiments of the present invention disclosed herein.

In an embodiment of the present invention, the concentrated de-icing solution stored in the storage tank 148 may be transferred to the de-icing tank 134 when the prestored de-icing solution may be utilized and/or may be in a proportionate shortage of the diluted de-icing solution. In an embodiment of the present invention, the storage tank 148 may be connected to the de-icing tank 134 using a connecting tube 150 (as shown in FIG. 7). In an embodiment of the present invention, the storage tank 148 is further explained in detail in conjunction with FIG. 7.

In an embodiment of the present invention, the sprinkler system 160 may be configured to spray the diluted de-icing solution from the de-icing tank 134 on the surface to loosen up accumulated snow on the surface. The diluted de-icing solution may further prevent formation of the black snow or ice on the surface, in an embodiment of the present invention. In an embodiment of the present invention, the sprinkler unit 106 may be attached to the vehicle 200 at locations such as, but not limited to, a right side of the vehicle 200, a left side of the vehicle 200, a rear side of the vehicle 200 near the outlet 136 of the de-icing tank 134, underneath of the vehicle 200, and so forth. In a preferred embodiment of the present invention, the sprinkler unit 106 may be arranged at a front side of the vehicle 200. Embodiments of the present invention are intended to include or otherwise cover any location for attachment of the sprinkler unit 106 to the vehicle 200. In an embodiment of the present invention, the sprinkler unit 106 is further explained in detail in conjunction with FIG. 7.

In an embodiment of the present invention, the device 100 may comprise a controller 166 configured to regulate the temperature of the diluted de-icing solution in the de-icing tank 134 based on external weather conditions. The external weather conditions may be detected by a weather sensor 168, in an embodiment of the present invention. The controller 166 may be connected to a first sensor 142 (as shown in FIG. 7), and a second sensor 156 (as shown in FIG. 7).

The controller 166 may further be configured to execute computer-executable instructions to generate an output relating to the device 100. According to embodiments of the present invention, the controller 166 may be, but not limited to, a Programmable Logic Control (PLC) unit, a microprocessor, a development board, and so forth. Embodiments of the present invention are intended to include or otherwise cover any type of the controller 166 including known, related art, and/or later developed technologies. In an embodiment of the present invention, the working of the controller 166 is further explained in detail in conjunction with FIG. 8.

In an embodiment of the present invention, a display unit 170 may be installed on an instrument cluster (not shown) of the device 100. In an embodiment of the present invention, the display unit 170 may be installed in a visual proximity of the operator. The display unit 170 may be adapted to display the received concentration and the detected volume of the diluted de-icing solution from a first sensor 142 to the operator.

The display unit 170 may be, but not limited to, a Liquid Crystal Display (LCD), a Light Emitting Diode (LED) display, an Organic Light Emitting Diode (OLED) display, and so forth. Further, the display unit 170 may feature a backlight that may be turned on and/or turned off based on a requirement. Embodiments of the present invention are intended to include or otherwise cover any type of the display unit 170 including known, related art, and/or later developed technologies.

In an embodiment of the present invention, a motor 172 may be arranged inside the de-icing tank 134. The motor 172 may be adapted to discharge an excess amount of the diluted de-icing solution through a discharging part 144 of the de-icing tank 134 to prevent overflow of the diluted de-icing solution. According to embodiments of the present invention, the motor 172 may be, but not limited to, the alternating current motor, the Brushless Direct Current (BLDC) motor, the submersible motor, and so forth. Embodiments of the present invention are intended to include or otherwise cover any type of the motor 172, including known, related art, and/or later developed technologies.

In an embodiment of the present invention, a power supply unit 174 may provide an operational power to the components of the device 100 such as, but not limited to, the cylindrical brushes 108, the circular brushes 118*a*-118*b*, the actuator 120, the turbo-suction motor 124, the heated metal grid 130, heated wires 138, the motor 172, and the controller 166. Further, the power supply unit 174 may provide an operational power to other components of the device 100 such as, but not limited to, the first sensor 142, a first agitator 140, the second sensor 156, a second agitator 158, the weather sensor 168, and so forth. Embodiments of the present invention are intended to include or otherwise cover components of the device 100 that may receive the operational power from the power supply unit 174, including known, related art, and/or later developed technologies. In an embodiment of the present invention, the power supplied from the power supply unit 174 may be regulated using a regulator (not shown).

In an embodiment of the present invention, the power supply unit 174 may be a battery. In another embodiment of the present invention, the power supply unit 174 may provide power from a wall-outlet power supply. In yet another exemplary embodiment of the present invention, the power supply unit 174 may supply power from any source.

In an embodiment of the present invention, a single full charge of the battery may enable the device 100 to de-ice and clear the surface with an area ranging from 20000 square feet (sq ft.) to 24000 square feet (sq ft.) having a snow height ranging from 11 inches (in) to 13 inches (in). In a preferred embodiment of the present invention, the single full charge of the battery may enable the device 100 to de-ice and clear the surface with the area of 22000 square feet (sq ft.) having the snow height of 12 inches (in). Embodiments of the present invention are intended to include or otherwise cover any area of the surface and snow height on the corresponding surface that may be de-iced and cleared within the single full charge of the battery.

In an embodiment of the present invention, the battery power supply may be from a rechargeable battery. In another embodiment of the present invention, the battery power supply may be from a non-rechargeable battery. According to embodiments of the present invention, the battery for power supply may be of any composition such as, but not limited to, a Nickel-Cadmium battery, a Nickel-Metal Hydride battery, a Zinc-Carbon battery, a Lithium-Ion battery, and so forth. Embodiments of the present invention are intended to include or otherwise cover any composition of the battery, including known, related art, and/or later developed technologies.

In an embodiment of the present invention, the wall-outlet power supply may be from a grid power line supply. In another embodiment of the present invention, the wall-outlet power supply may be from a generator line power supply. According to embodiments of the present invention, the wall-outlet power supply may be of any rating such as, but not limited to, a 110-volt supply, a 220-volt supply, and so forth. Embodiments of the present invention are intended to include or otherwise cover any rating of the wall-outlet power supply, including known, related art, and/or later developed technologies.

According to an embodiment of the present invention, the power supply unit 174 may supply an Alternating Current (AC) power supply. According to another embodiment of the present invention, the power supply unit 174 may supply a Direct Current (DC) power supply. According to yet another embodiment of the present invention, the power supply unit 174 may supply any type of power supply.

In another embodiment of the present invention, a cluster of the device 100 may operate synchronously around a city or a town for de-icing. Each of the device 100 may be allocated a cluster and/or a sector in the city or the town for de-icing. Further, the device 100 may comprise a communication unit (not shown) that may enable operators of all the device 100 in the cluster to communicate and conduct the de-icing operation more systematically and efficiently.

In yet another embodiment of the present invention, the device 100 may be capable of being geo-located and tracked. The provision of geo and tracking of the device 100 may be enabled by a location tracker (not shown).

In an exemplary scenario, the tracked location may be represented in x° North, y° East coordinated format. In another exemplary scenario, the tracked location may be in x° North y minute, and z second, a° East b minute, and c second coordinated format. In yet another exemplary scenario, the tracked location may be in any format. According to embodiments of the present invention, the location tracker may be of any type such as, but not limited to, a Global Navigation Satellite System (GLONASS), a Real-time locating system (RTLS), and so forth. In a preferred embodiment of the present invention, the location tracker may be a Global Positioning System (GPS). Embodiments of the present invention are intended to include or otherwise cover any type of the location tracker, including known, related art, and/or later developed technologies.

In a further embodiment of the present invention, the vehicle 200 may be the hand-driven mover. The hand-driven mover may be adapted to scrape off and collect snow or ice accumulated on surfaces, for example, but not limited to, the sidewalks, the driveways, the alleys, and the narrower areas after the snowfall. The hand-driven mover may include a handle 176 to maneuver and navigate the hand-driven mover on the surface. The handle 176 may be removably attached with the hand-driven mover, such that the handle 176 may be removed when the hand-driven mover is not in use and may be attached again before operating the hand-driven mover. In an embodiment of the present invention, the handle 176 may be telescopic in nature, such that the user may expand the handle 176 up to an optimal height for operating the device 100. The handle 176 may further provide grips (not shown) to enable the user to rigidly hold the handle 176. According to embodiments of the present invention, the handle 176 and the grips may be constructed of any material such as, but not limited to, a metallic material, a wooden material, a plastic material, and so forth. Embodiments of the present invention are intended to include or otherwise cover any material for construction of the handle 176 and the grips, including known, related art, and/or later developed technologies.

Figure 2B:
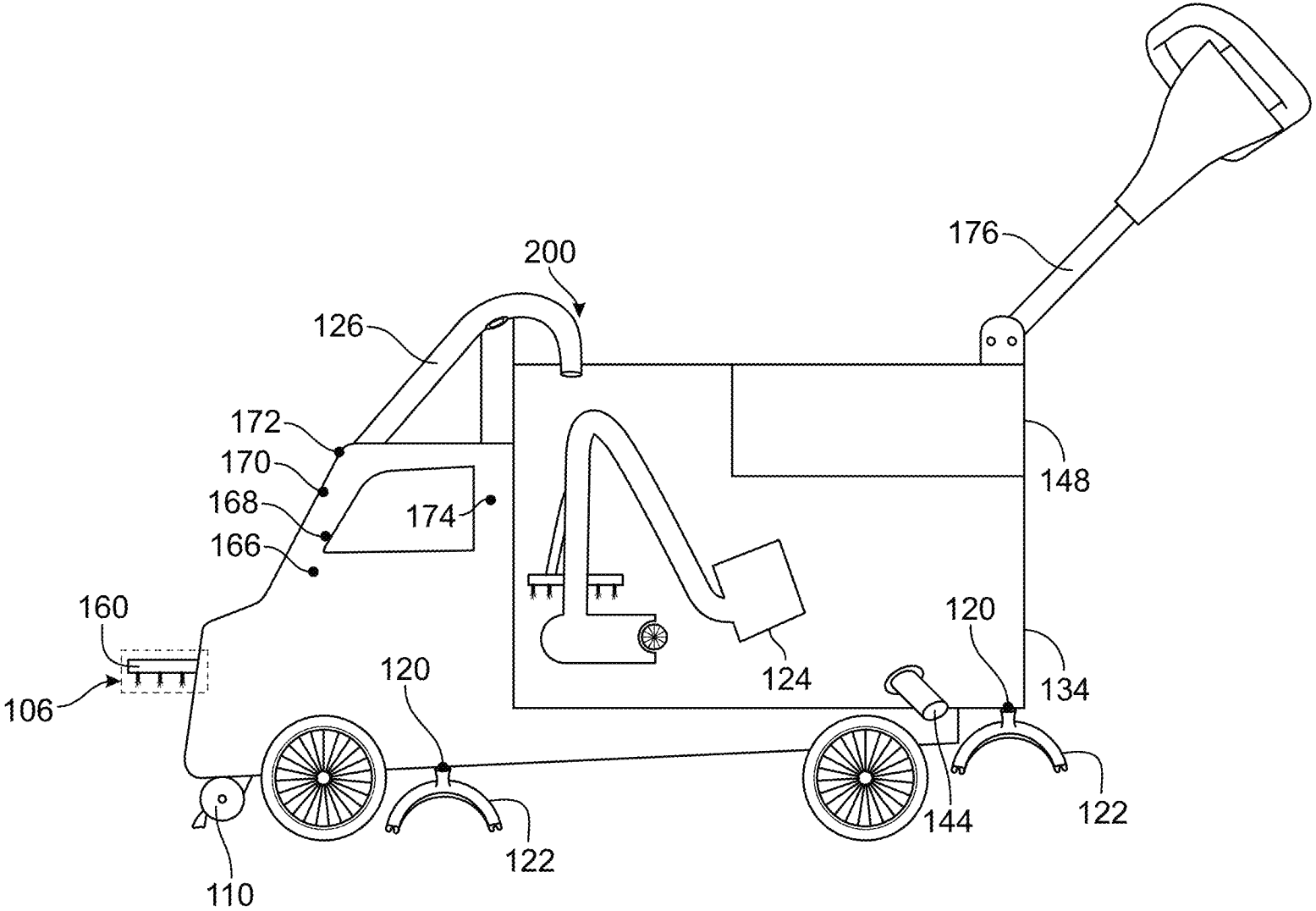
FIG. 2B illustrates an installation of the mobile snow processing and de-icing device on a vehicle, according to another embodiments of the present invention disclosed herein.

FIG. 2B illustrates an installation of the device 100 on the vehicle 200, according to another embodiments of the present invention disclosed herein. In an embodiment of the present invention, the vehicle 200 depicted in the FIG. 2B may be an iteration and/or a permutation of the vehicle 200 depicted in the FIG. 2A. In the iteration of the vehicle 200 as illustrated in the FIG. 2B, the cylindrical brush 108 (as shown in FIG. 2A) in the vehicle 200 may be replaced with a scraper 110. The scraper 110 may further be explained in detail in conjunction with FIG. 3B.

Figure 3A:
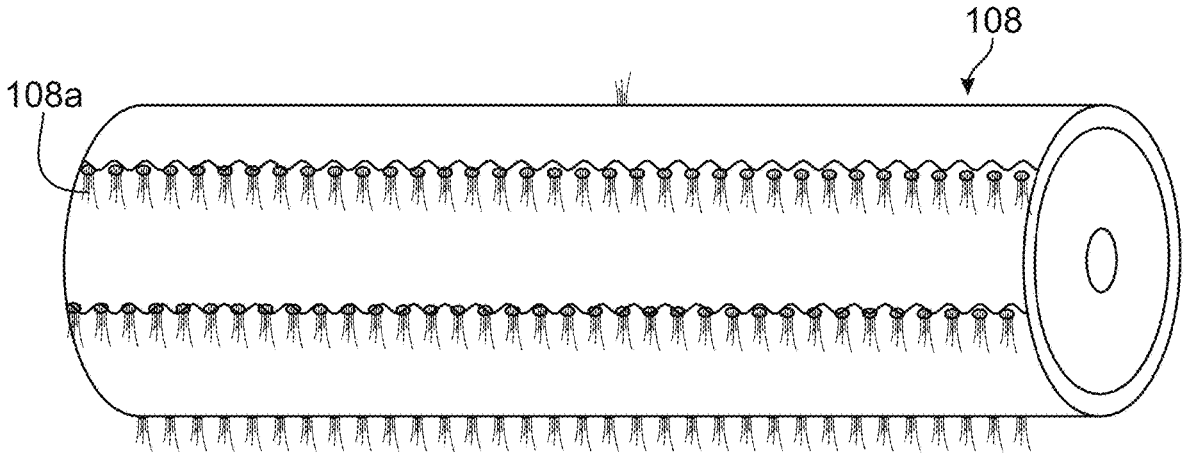
FIG. 3A illustrates a cylindrical brush of the mobile snow processing and de-icing device, according to embodiments of the present invention disclosed herein.

FIG. 3A illustrates the cylindrical brush 108 of the device 100, according to embodiments of the present invention disclosed herein.

In an embodiment of the present invention, the cylindrical brush 108 may be configured to collect the scraped off snow from the surface. The cylindrical brush 108 may comprise bristles 108*a*, that may be adapted to loosen up the snow on the surface which provides more convenience for scraping off the snow. The bristles 108*a* may rub against the snow on the surface, and the friction generated between the snow on the surface and the bristles 108*a* may lead to loosening up of the snow and eventually scraping off the snow on the road.

In an embodiment of the present invention, the cylindrical brush 108 may scrape off the snow from the front side of the device 100. The cylindrical brush 108 may further scrape off the snow from sides such as a right side and a left side of the device 100, in another embodiment of the present invention. In yet another embodiment of the present invention, the cylindrical brush 108 may collect the snow from any side of the device 100.

In an embodiment of the present invention, the cylindrical brush 108 may be adapted to rotate in a circular direction. In an embodiment of the present invention, the cylindrical brush 108 may rotate in an anti-clockwise manner. In another embodiment of the present invention, the cylindrical brush 108 may rotate in a clockwise manner.

In an embodiment of the present invention, the cylindrical brush 108 may be extendible and may be telescopic in construction. The extendibility of the cylindrical brush 108 may enable scraping off the snow from a larger area of the surface without much deviation of the device 100. The extendibility of the cylindrical brush 108 may further allow scraping off the snow from corners and more obscure locations.

In an embodiment of the present invention, the cylindrical brush 108 may be de-attachable from the collecting unit 102. Further, the de-attach ability of the cylindrical brush 108 from the collecting unit 102 may allow replacement of the cylindrical brush 108, when the bristles 108*a* may not be in a workable state.

According to embodiments of the present invention, the bristles 108*a* may be constructed of stiff material such as, but not limited to, a metallic material, a fibrous material, a plastic material, and so forth. Embodiments of the present invention are intended to include or otherwise cover any material for the construction of the bristles 108*a* of the cylindrical brush 108, including known, related art, and/or later developed technologies.

According to embodiments of the present invention, the cylindrical brush 108 may be constructed of material such as, but not limited to, a metallic material, a wooden material, a plastic material, and so forth. Embodiments of the present invention are intended to include or otherwise cover any material for the construction of the cylindrical brush 108, including known, related art, and/or later developed technologies.

Figure 3B:
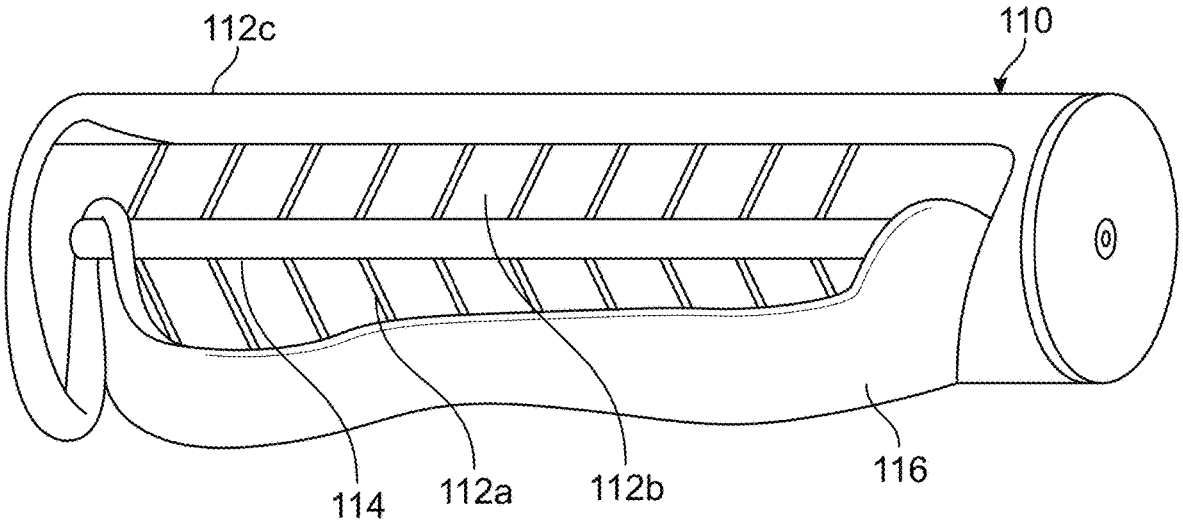
FIG. 3B illustrates a scraper of the mobile snow processing and de-icing device, according to embodiments of the present invention disclosed herein.

FIG. 3B illustrates the scraper 110 of the device 100, according to embodiments of the present invention disclosed herein.

In certain circumstances, the surface may be covered with packed snow or thick ice. In such cases, the cylindrical brush 108 may be replaced with the scraper 110 (as shown in the FIG. 2B). The scraper 110 may rotate in either the clockwise manner or preferably in the anti-clockwise manner to scrape off the snow from the surface. The scraper 110 may comprise flaps 112*a*-112*c*. According to embodiments of the present invention, the flaps 112*a*-112*c* may be constructed of any material such as, but not limited to, a metallic material, a wooden material, a hard rubber material, a plastic material, and so forth. In a preferred embodiment of the present invention, the flaps 112*a*-112*c* may be constructed of a hard plastic material. Embodiments of the present invention are intended to include or otherwise cover any material for construction of the flaps 112*a*-112*c*, including known, related art, and/or later developed technologies. The flaps 112*a*-112*c* of the scraper 110 may further comprise a rib 114 providing support to each of the flaps 112*a*-112*c* of the scraper 110. Further, the scraper 110 may be attached with a protective cover 116 to provide a shielding to the flaps 112*a*-112*c* of the scraper. In a preferred embodiment of the present invention, the scraper 110 may comprise three flaps 112*a*-112*c*. However, the scraper 110 may comprise any number of the flaps 112*a*-112*c*.

Figure 4:
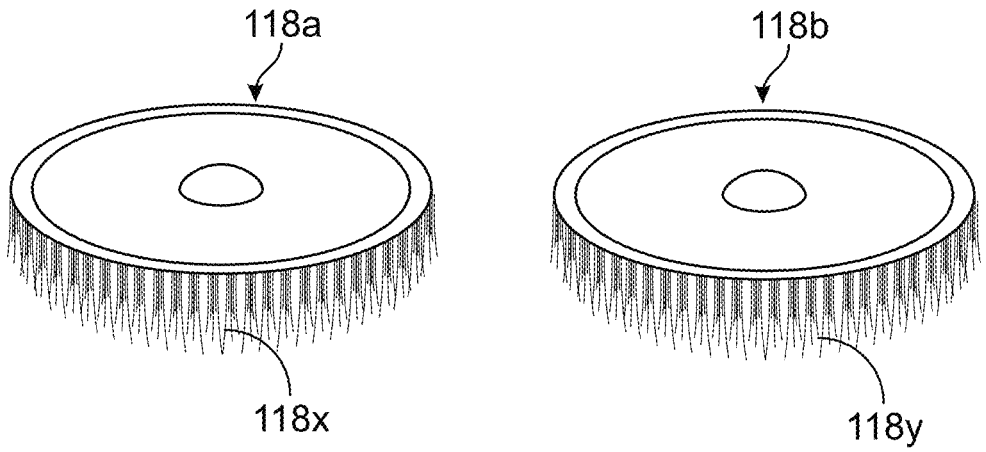
FIG. 4 illustrates circular brushes of the mobile snow processing and de-icing device, according to embodiments of the present invention disclosed herein.

FIG. 4 illustrates the circular brushes 118*a*-118*b* of the device 100, according to embodiments of the present invention disclosed herein. In an embodiment of the present invention, the circular brushes 118*a*-118*b* may be a set of a first circular brush 118*a* and a second circular brush 118*b*.

In an embodiment of the present invention, the circular brushes 118*a*-118*b* may be configured to scrape off the snow from the surface. The circular brushes 118*a*-118*b* may comprise the bristles 118*x*-118*y*, that may be adapted to scrape off the snow from the surface. The bristles 118*x*-118*y* may rub against the snow on the surface, and the friction generated between the snow on the surface and the bristles 118*x*-118*y* may lead to loosening up of the snow and eventually scraping off the snow from the surface.

In another embodiment of the present invention, the circular brushes 118*a*-118*b* may scrape off the snow from the front side of the device 100. The circular brushes 118*a*-118*b* may further scrape off the snow from the sides such as a right side and a left side of the device 100. In a further embodiment of the present invention, the cylindrical brush 108 may scrape off the snow from any side of the device 100.

In an embodiment of the present invention, the circular brushes 118*a*-118*b* may be adapted to rotate in the circular direction. The circular brushes 118*a*-118*b* may scrape off the snow in the circular direction. In an embodiment of the present invention, the circular brushes 118*a*-118*b* may rotate in the anti-clockwise manner. In another embodiment of the present invention, the circular brushes 118*a*-118*b* may rotate in the clockwise manner. In yet another embodiment of the present invention, the first circular brush 118*a* may rotate in the and the anti-clockwise manner and the second circular brush 118*b* in the clockwise manner, or vice-versa.

In an embodiment of the present invention, the circular brushes 118*a*-118*b* may be extendible and may be telescopic in construction. The extendibility of the circular brushes 118*a*-118*b* may enable scraping off the snow from the larger area of the surface without much of the deviation of the device 100. The extendibility of the circular brushes 118*a*-118*b* may further allow scraping off the snow from the corners and more obscure locations.

In an embodiment of the present invention, the first circular brush 118*a* and the second circular brush 118*b* may be arranged on the right side and the left side of the cylindrical brush 108 and/or the collecting unit 102 respectively, or vice-versa.

In an embodiment of the present invention, the circular brushes 118*a*-118*b* may be de-attachable from the collecting unit 102. Further, the de-attach ability of the circular brushes 118*a*-118*b* from the collecting unit 102 may allow the replacement of the circular brushes 118*a*-118*b* when the bristles 118*x*-118*y* may not be in the workable state.

According to embodiments of the present invention, the bristles 118*x*-118*y* may be constructed of stiff material such as, but not limited to, a metallic material, a fibrous material, a plastic material, and so forth. Embodiments of the present invention are intended to include or otherwise cover any material for the construction of the bristles 118*x*-118*y* of the circular brushes 118*a*-118*b*, including known, related art, and/or later developed technologies.

According to embodiments of the present invention, the circular brushes 118*a*-118*b* may be constructed of material such as, but not limited to, a metallic material, a wooden material, a plastic material, and so forth. Embodiments of the present invention are intended to include or otherwise cover any material for the construction of the circular brushes 118*a*-118*b*, including known, related art, and/or later developed technologies.

FIG. 5 illustrates the helical screw 128 of the device 100, according to embodiments of the present invention disclosed herein.

In an embodiment of the present invention, the helical screw 128 may be arranged inside the collecting tube 126. The snow swiped by the turbo-suction sweeper 122 may ride onto groves of the helical screw 128. Further, the helical screw 128 may rotate enabling the efficient transportation of the snow from the collecting tube 126 into the de-icing tank 134. According to embodiments of the present invention, the helical screw 128 may be, but not limited to, an Archimedes screw, an Egyptian screw, and so forth. Embodiments of the present invention are intended to include or otherwise cover any type of the helical screw 128, including known, related art, and/or later developed technologies.

According to embodiments of the present invention, the helical screw 128 may be constructed of any material such as, but not limited to, a metallic material, a wooden material, a ceramic material, a plastic material, a carbon fiber material, and so forth. Embodiments of the present invention are intended to include or otherwise cover any material for the construction of the helical screw 128, including known, related art, and/or later developed technologies.

FIG. 6 illustrates the connectivity of the turbo-suction sweeper 122 and the turbo-suction motor 124 through the collecting tube 126 of the device 100, according to embodiments of the present invention disclosed herein.

In an embodiment of the present invention, the turbo-suction sweeper 122 may be adapted to sweep the scraped off snow by the cylindrical brush 108 and the circular brushes 118*a*-118*b*. According to embodiments of the present invention, the turbo-suction sweeper 122 may be of any shape such as, but not limited to, a circular shape, a rectangular shape, a circular shape, and so forth. In a preferred embodiment of the present invention, the turbo-suction sweeper 122 may be of a semi-circular shape. Embodiments of the present invention are intended to include or otherwise cover any shape of the turbo-suction sweeper 122, including known, related art, and/or later developed technologies.

In an embodiment of the present invention, the turbo-suction sweeper 122 may comprise a layered folded rubber (not shown). In an embodiment of the present invention, the layered folded rubber may be detachably attached with the turbo-suction sweeper 122. The layered folded rubber may be adapted to absorb an excessive left-over diluted de-icing solution accumulated on the surfaces such as the sidewalks, the driveways, the alleys, and the narrower areas, and so forth. The excessive left-over diluted de-icing solution may be referred to as the diluted de-icing solution that may be left on the surface after de-icing the snow. In another embodiment of the present invention, the layered folded rubber may further absorb the snow, liquified by the diluted de-icing solution, on the surface. In an embodiment of the present invention, the layered folded rubber may be encapsulated in a metal housing (not shown). The metal housing may be applied on an upper region of the layered folded rubber. In another embodiment of the present invention, a lower region of the layered folded rubber may be left uncovered by the metal housing, as the lower region of the layered folded rubber may be adapted to be in contact with the surface for absorption of the diluted de-icing solution and the snow.

In an embodiments of the present invention, the layered folded rubber may be detached from the turbo-suction sweeper 122 when clearing the specific surfaces. By detaching the layered folded rubber from the turbo-suction sweeper 122, the excessive left-over diluted de-icing solution on the surface may be retained on the surface to prevent freezing of the snow, which may further keep the surface de-iced for longer periods. The specific surfaces may be such as the roads, the highways, the freeways, the airport runways, and so forth, in an embodiment of the present invention.

Further, the metal housing of the turbo-suction sweeper 122 may comprise a nozzle (not shown). The nozzle of the turbo-suction sweeper 122 may be attached inside of the collecting tube 126, in an embodiment of the present invention. In an embodiment of the present invention, the nozzle may navigate the movement of the absorbed diluted de-icing solution and the snow from the layered folded rubber into the collecting tube 126.

The turbo-suction motor 124 may be connected to the turbo-suction sweeper 122 through the collecting tube 126 and may facilitate the movement of the snow into the de-icing tank 134. According to embodiments of the present invention, the turbo-suction motor 124 may be, but not limited to, the alternating current motor, the Brushless Direct Current (BLDC) motor, the submersible motor, and so forth. Embodiments of the present invention are intended to include or otherwise cover any type of the turbo-suction motor 124, including known, related art, and/or later developed technologies.

In another embodiment of the present invention, the turbo-suction motor 124 may further be adapted to adjust the sweeping intensity of the turbo-suction sweeper 122 based on a density of the snow on the surface. In an exemplary embodiment, if the swiped off snow on the surface may be in the higher density, then the sweeping intensity of the turbo-suction motor 124 may be adjusted to the high setting. However, if the swiped off snow on the surface may be in the lower density, then the sweeping intensity of the turbo-suction motor 124 may be adjusted to the medium to low setting.

Further, the snow swiped by the turbo-suction sweeper 122 may be transferred to the de-icing tank 134 through the collecting tube 126. The collecting tube 126 may further feature the helical screw 128 for fast and efficient transfer of the scraped off snow in the de-icing tank 134. In an embodiment of the present invention, the helical screw 128 may aid the propagation of the collected snow into the de-icing tank 134, as discussed above.

In another embodiment of the present invention, the turbo-suction sweeper 122 may be extendible and may be telescopic in construction. The extendibility of the turbo-suction sweeper 122 may enable the device 100 to cover more area on the road for sweeping the snow without much deviation. The extendibility of the turbo-suction sweeper 122 may further allow sweeping and collection of the snow from corners and more obscure locations.

In yet another embodiment of the present invention, a grill (not shown) may be arranged at the sweeping mouth of the turbo-suction sweeper 122. The grill may prevent an entry of foreign objects into the de-icing tank 134. According to embodiments of the present invention, the foreign objects may be for example, but not limited to, stones, pebbles, garbage, plastic pieces, glass pieces, and so forth. Embodiments of the present invention are intended to include or otherwise cover any foreign objects that may be prevented from entry in the sweeping mouth of the turbo-suction sweeper 122 using the grill, including known, related art, and/or later developed technologies.

In an embodiment of the present invention, the turbo-suction motor 124 may be arranged in a reachable proximity to the operator. The operator may control a suction power of the turbo-suction sweeper 122 based on the scraped off snow to be swiped using the turbo-suction sweeper 122. In an exemplary scenario, the turbo-suction motor 124 may be operated at a very high power when the scraped off snow may be in big chunks of pieces and may be in a rigid state. However, the turbo-suction motor 124 may be operated at a medium to low power when the scraped off snow may be in a powdered form.

In a further embodiment of the present invention, the turbo-suction motor 124 may be connected to the sprinkler system 160. The turbo-suction motor 124 may further enable the sprinkler system 160 to spray the diluted de-icing solution on the snow and the cleared surfaces to prevent formation of the black snow on the surface.

FIG. 7 illustrates a diagram of the de-icing tank 134 of the device 100, according to embodiments of the present invention disclosed herein.

According to embodiments of the present invention, the de-icing tank 134 may comprise the heated metal grid 130, the inlet 132, the outlet 136, the heated wires 138, the first agitator 140, the first sensor 142, the discharging part 144, a vent 146, the sprinkler system 160, sprinkler heads 162*a*-162*n*, and a horizontal tube 164.

In an embodiment of the present invention, the heated metal grid 130 may be arranged at the inlet 132 of the de-icing tank 134 to convert the collected snow into the slush. According to embodiments of the present invention, the heated metal grid 130 may be in a structure of, but not limited to, a matrix structure, a honeycomb structure, a bar structure, a polka dots structure, and so forth. Embodiments of the present invention are intended to include or otherwise cover any structure of the heated metal grid 130, including known, related art, and/or later developed technologies. According to embodiments of the present invention, the heated metal grid 130 may be constructed of any electrically heat inducing material such as, but not limited to, a nichrome material, a copper material, an insulated tungsten material, and so forth. Embodiments of the present invention are intended to include or otherwise cover any material for the construction of the heated metal grid 130, including known, related art, and/or later developed technologies.

In an embodiment of the present invention, the de-icing tank 134 may receive the slush and may further mix the received slush with the prestored de-icing solution to prepare the diluted de-icing solution. The diluted de-icing solution may be sprinkled out using the sprinkler unit 106 attached at the outlet 136 of the de-icing tank 134. In a further embodiment of the present invention, the de-icing tank 134 may comprise a filtering unit (not shown). The filtering unit may be adapted to filter the received slush, in an embodiment of the present invention. According to embodiments of the present invention, the filtering unit may be for example, but not limited to, a paper-based filtering unit, a cloth-based filtering unit, a ceramic filtering unit, and so forth. Embodiments of the present invention are intended to include or otherwise cover any type of the filtering unit, including known, related art, and/or later developed technologies.

In an embodiment of the present invention, the de-icing tank 134 may pre-store the diluted de-icing solution. The de-icing tank 134 may pre-store the diluted de-icing solution in a volume range of 10% to 20%. In another embodiment of the present invention, the diluted de-icing solution may be developed by adding the concentrated de-icing solution from the storage tank 148 into the melted slush stored in the de-icing tank 134.

In an embodiment of the present invention, the diluted de-icing solution may reduce the freezing point temperature of the received slush in the de-icing tank 134 from 0 degrees Celsius (° C.) to −9.44 degrees Celsius (° C.). Further, the diluted de-icing solution may be sprayed on the cleared surfaces. Upon sprinkling the diluted de-icing solution on the cleared surfaces, the diluted de-icing solution may prevent re-accumulation of the snow, and may further delay a freezing of the snow on the cleared surface.

In an embodiment of the present invention, the de-icing tank 134 may have a variable capacity. In an embodiment of the present invention, a maximum capacity of the de-icing tank 134 may be 30,000 gallons. In another embodiment of the present invention, the maximum capacity of the de-icing tank 134 may be 300 gallons. Embodiments of the present invention are intended to include or otherwise cover any capacity of the de-icing tank 134, including known, related art, and/or later developed technologies.

According to embodiments of the present invention, the diluted de-icing solution may be the brine solution with a consistency ranging from 24% concentration of Calcium Chloride (CaCl) to 26% concentration of Calcium Chloride (CaCl). In another embodiment of the present invention, the brine solution may be a saltwater solution, particularly a highly concentrated water solution of common salt (Sodium Chloride (NaCl)).

The brine solution may further comprise of environmentally friendly chemicals. According to embodiments of the present invention, the environmentally friendly chemicals may be for example, but not limited to, the glycerol, the peony leaves, stalks, the beetroot solution 20/80 (v/v), and so forth. Embodiments of the present invention are intended to include or otherwise cover any environmentally friendly chemicals that may be mixed with the brine solution for production of the diluted de-icing solution, including known, related art, and/or later developed technologies.

In another embodiment of the present invention, the utilization of the environmentally friendly chemicals may reduce a corrosive nature of the brine solution. The reduced corrosive nature of the brine solution may prevent rusting and degradation of the de-icing tank 134 and other components of the device 100. Further, the environmentally friendly chemicals may cause less environmental pollution, as in the end, the diluted de-icing solution in the de-icing tank 134 must be discharged in dumping locations such as, but not limited to, a river, a pond, a farm, a canal, a land, a well, and so forth. Upon discharge of the diluted de-icing solution at the dumping locations, the presence of the environmentally friendly chemicals may cause less environmental pollution when compared with bare brine solution.

According to embodiments of the present invention, the de-icing tank 134 may be constructed of material such as, but not limited to, a metallic material, a ceramic material, a plastic material, and so forth. Embodiments of the present invention are intended to include or otherwise cover any material for the construction of the de-icing tank 134, including known, related art, and/or later developed technologies.

In an embodiment of the present invention, a plurality of the heated wires 138 may be installed within the de-icing tank 134 to prevent freezing of the diluted de-icing solution in the de-icing tank 134. The heated wires 138 may further be adapted to melt the received slush from the collecting tube 126 via the heated metal grid 130 into liquid form such as, water. In an embodiment of the present invention, the heated wires 138 may be adapted to heat up based on a signal received from the controller 166. In an embodiment of the present invention, the heated wires 138 may further be adapted to maintain a constant temperature of the diluted de-icing solution. In an embodiment of the present invention, the heated wires 138 may maintain the temperature of the diluted de-icing solution above 0 degrees Celsius (° C.). The heated wires 138 may keep the temperature of the diluted de-icing solution above 0 degrees Celsius (C), and by doing so the diluted de-icing solution may always be in a liquid form.

The heated wires 138 may be adapted to be electrically heated. Upon electrical heating of the heated wires 138, the diluted de-icing solution in the de-icing tank 134 may tend to change the state from the solid state and/or the semi-solid state to the liquid state, hence preventing freezing of the diluted de-icing solution in the de-icing tank 134. According to embodiments of the present invention, the heated wires 138 may be constructed of any electrically heat inducing material such as, but not limited to, a nichrome material, a copper material, an insulated tungsten material, and so forth. Embodiments of the present invention are intended to include or otherwise cover any material for the construction of the heated wires 138, including known, related art, and/or later developed technologies.

The first agitator 140 and the first sensor 142 may be arranged at the base of the de-icing tank 134, in an embodiment of the present invention. The first agitator 140 may maintain a homogeneity of the diluted de-icing solution stored in the de-icing tank 134. The first agitator 140 may be adapted to rotate at the pre-defined speed. Upon continuous rotation of the first agitator 140, the diluted de-icing solution stored in the de-icing tank 134 may be stirred continuously. By continuous stirring, the diluted de-icing solution stored in the de-icing tank 134 may not freeze and stay in the liquid form.

In an embodiment of the present invention, the first sensor 142 may measure a concentration and a volume of the diluted de-icing solution stored in the de-icing tank 134.

In an embodiment of the present invention, the vent 146 may be arranged on a top of the de-icing tank 134. The vent 146 may further be arranged on the sides of the de-icing tank 134, in another embodiment of the present invention. The vent 146 may be adapted to release and exhaust fumes produced by the diluted de-icing solution inside the de-icing tank 134.

According to embodiments of the present invention, the storage tank 148 may comprise the connecting tube 150, an opening 152, a valve 154, the second sensor 156, and the second agitator 158.

According to embodiments of the present invention, the storage tank 148 may store the concentrated de-icing solution. The concentrated de-icing solution stored in the storage tank 148 may ensure proper concentration of the diluted de-icing solution within the de-icing tank 134. The concentrated de-icing solution stored in the storage tank 148 may be transmitted into the de-icing tank 134 through the connecting tube 150. The storage tank 148 may comprise the opening 152 with the valve 154. The valve 154 may be arranged at the opening 152 and may control the flow of the concentrated de-icing solution from the storage tank 148 to the de-icing tank 134.

The second agitator 158 and the second sensor 156 may be arranged at the base of the storage tank 148, in an embodiment of the present invention. The second agitator 158 may maintain the homogeneity of the concentrated de-icing solution stored in the storage tank 148. The second agitator 158 may be adapted to rotate at the pre-defined speed. Upon continuous rotation of the second agitator 158, the concentrated de-icing solution stored in the storage tank 148 may be stirred continuously. By continuous stirring, the concentrated de-icing solution stored in the storage tank 148 may not freeze and stay in the liquid form.

In an embodiment of the present invention, the second sensor 156 may measure the concentration and the volume of the concentrated de-icing solution stored in the storage tank 148.

In an embodiment of the present invention, the sprinkler system 160 may comprise a plurality of the sprinkler heads 162*a*-162*n* for spraying the diluted de-icing solution on cleared surfaces. The plurality of the sprinkler heads 162*a*-162*n* may be equally distributed and aligned on the horizontal tube 164, in an embodiment of the present invention.

In an embodiment of the present invention, the horizontal tube 164 may have a connecting nibble (not shown) that may be attached to the outlet 136 of the de-icing tank 134. The attachment of the connecting nibble at the outlet 136 of the de-icing tank 134 may be sealed using a sealant (not shown) to prevent leakage of the diluted de-icing solution.

In an embodiment of the present invention, the diluted de-icing solution may flow from the de-icing tank 134 via the outlet 136 and may pass into the horizontal tube 164. The diluted de-icing solution cached in the horizontal tube 164 may be sprayed using the plurality of the sprinkler heads 162*a*-162*n*. According to embodiments of the present invention, the diluted de-icing solution may be sprayed at a rate ranging from 500 milliliter per minute (ml/min) to 700 milliliter per minute (ml/min). Embodiments of the present invention are intended to include or otherwise cover any rate of spraying the diluted de-icing solution on the surface that may be beneficial to melt the snow on the surfaces.

In an embodiment of the present invention, the diluted de-icing solution may be sprayed continuously. In another embodiment of the present invention, the diluted de-icing solution may be sprayed in a rhythmic pattern. In yet another embodiment of the present invention, the diluted de-icing solution may be sprayed autonomously. In a further embodiment of the present invention, the diluted de-icing solution may be sprayed by the operator as per requirements.

Figure 8:
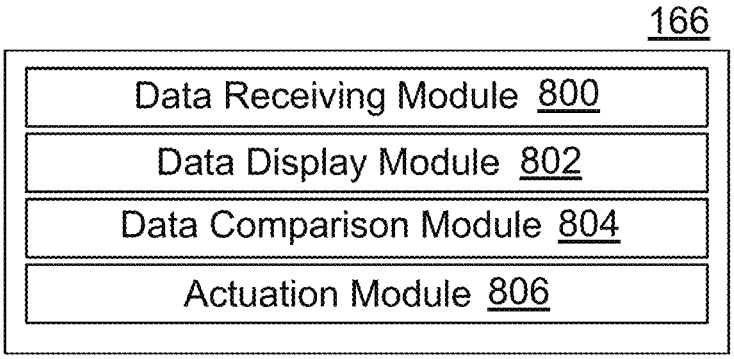
FIG. 8 illustrates a block diagram of a controller of the mobile snow processing and de-icing device, according to embodiments of the present invention disclosed herein.

FIG. 8 illustrates a block diagram of the controller 166 of the device 100, according to embodiments of the present invention disclosed herein. The controller 166 may comprise the computer-executable instructions in form of programming modules such as a data receiving module 800, a data display module 802, a data comparison module 804, and an actuation module 806.

In an embodiment of the present invention, the data receiving module 800 may be configured to receive the detected concentration and the detected volume of the diluted de-icing solution stored in the de-icing tank 134 from the first sensor 142. In another embodiment of the present invention, the data receiving module 800 may be configured to receive the detected concentration and the detected volume of the concentrated de-icing solution stored in the storage tank 148 from the second sensor 156.

In another embodiment of the present invention, the data receiving module 800 may be configured to receive the external weather conditions and the temperature of the diluted de-icing solution from the weather sensor 168. According to embodiments of the present invention, the external weather conditions may be, but not limited to, a cold weather, an extremely cold weather, a hot weather, and so forth. Embodiments of the present invention are intended to include or otherwise cover any external weather conditions, including known, related art, and/or later developed technologies.

Further, the data receiving module 800 may transmit the received concentration and the received volume of the diluted de-icing solution to the data display module 802 and the data comparison module 804. In an embodiment of the present invention, the data receiving module 800 may further transmit the received external weather conditions and the temperature of the diluted de-icing solution to the data display module 802 and the data comparison module 804.

In an embodiment of the present invention, the data display module 802 may be activated upon receipt of the concentration and the volume from the data receiving module 800. The data display module 802 may be configured to display the received concentration and the detected volume of the diluted de-icing solution to the operator.

In another embodiment of the present invention, the data display module 802 may be configured to display the received external weather conditions and the received temperature of the diluted de-icing solution from the data receiving module 800 on the display unit 170.

In an embodiment of the present invention, the data comparison module 804 may be activated upon receipt of the concentration and the volume from the data receiving module 800. The data comparison module 804 may further be activated upon receipt of the external weather conditions and the temperature of the diluted de-icing solution from the data receiving module 800.

The data comparison module 804 may be configured to compare the received concentration and the received volume of the diluted de-icing solution with predefined threshold values. In an embodiment of the present invention, the predefined threshold values for the concentration and the volume of the diluted de-icing solution may be 55 mol/liter.

Upon comparison, if the data comparison module 804 determines that the received concentrations or the received volume of the diluted de-icing solution exceeds the predefined threshold values, then the data comparison module 804 may transmit a first actuation signal to the actuation module 806. Otherwise, the data comparison module 804 may reactivate the data receiving module 800 to continue receiving and comparing the detected concentration and the detected volume of the diluted de-icing solution from the first sensor 142.

The data comparison module 804 may further be configured to compare the received the temperature of the diluted de-icing solution with a predefined threshold. In an embodiment of the present invention, the predefined threshold for the temperature of the diluted de-icing solution may be 4 degrees Celsius (° C.).

Upon comparison, if the data comparison module 804 determines that the received the temperature of the diluted de-icing solution exceeds the predefined threshold, then the data comparison module 804 may transmit a second actuation signal to the actuation module 806. Otherwise, the data comparison module 804 may reactivate the data receiving module 800 to continue receiving and comparing the temperature of the diluted de-icing solution from the weather sensor 168.

In an embodiment of the present invention, the actuation module 806 may be activated upon receipt of the first actuation signal from the data comparison module 804. The actuation module 806 may be configured to enable the motor 172 to discharge the excess amount of the diluted de-icing solution through the discharging part 144 of the de-icing tank 134 to prevent overflow.

In an embodiment of the present invention, the actuation module 806 may further be activated upon receipt of the second actuation signal from the data comparison module 804. The actuation module 806 may be configured to enable the heated wires 138 to initiate a heating of the diluted de-icing solution. The heating of the heated wires 138 may maintain the liquid form of the diluted de-icing solution.

Figure 9:
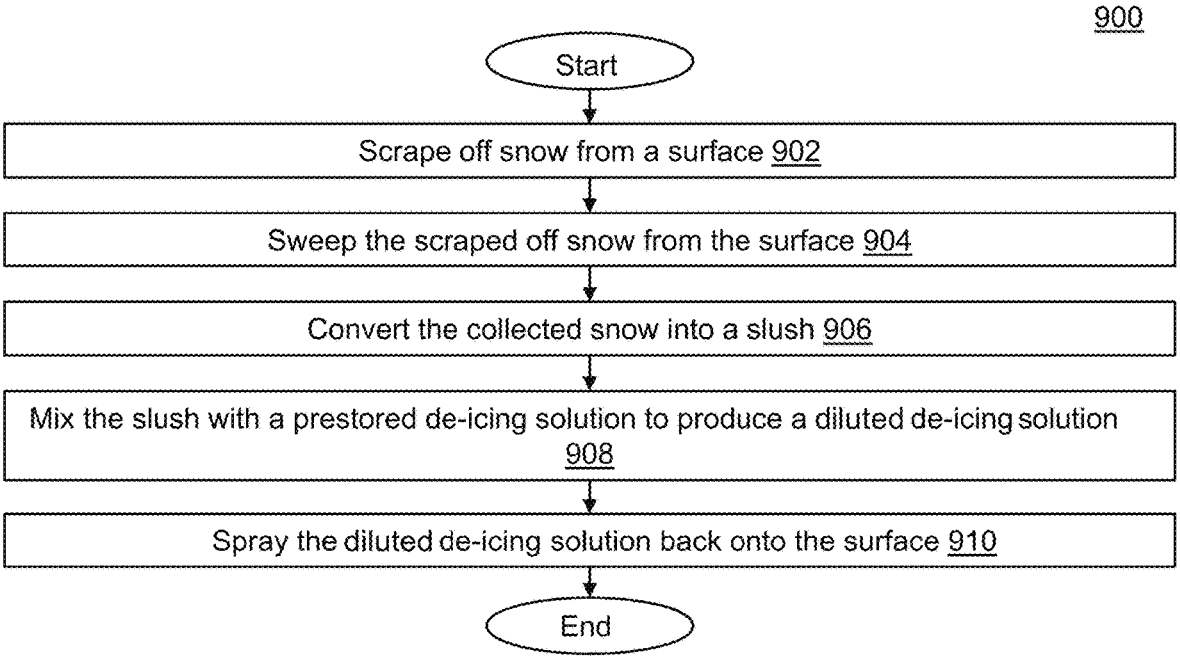
FIG. 9 illustrates a method for de-icing the snow from the surface by using the mobile snow processing and de-icing device, according to embodiments of the present invention disclosed herein.

FIG. 9 illustrates a method 900 for de-icing the snow from the surface by using the device 100, according to embodiments of the present invention disclosed herein.

At step 902, the device 100 may scrape off snow from the surface using the cylindrical brushes 108 and the circular brushes 118*a*-118*b*, as discussed above.

At step 904, the device 100 may sweep the scraped off snow from the surface using the turbo-suction sweeper 122 equipped with turbo-suction motor 124 via the collecting tube 126.

At step 906, the device 100 may convert the collected snow into the slush and/or water by using the heated metal grid 130.

Further, at step 908, the device 100 may mix the slush and/or water with the prestored de-icing solution to produce the diluted de-icing solution.

At step 910, the device 100 may spray the diluted de-icing solution back onto the surface to prevent the black snow formation on the surface.

Figure 10:
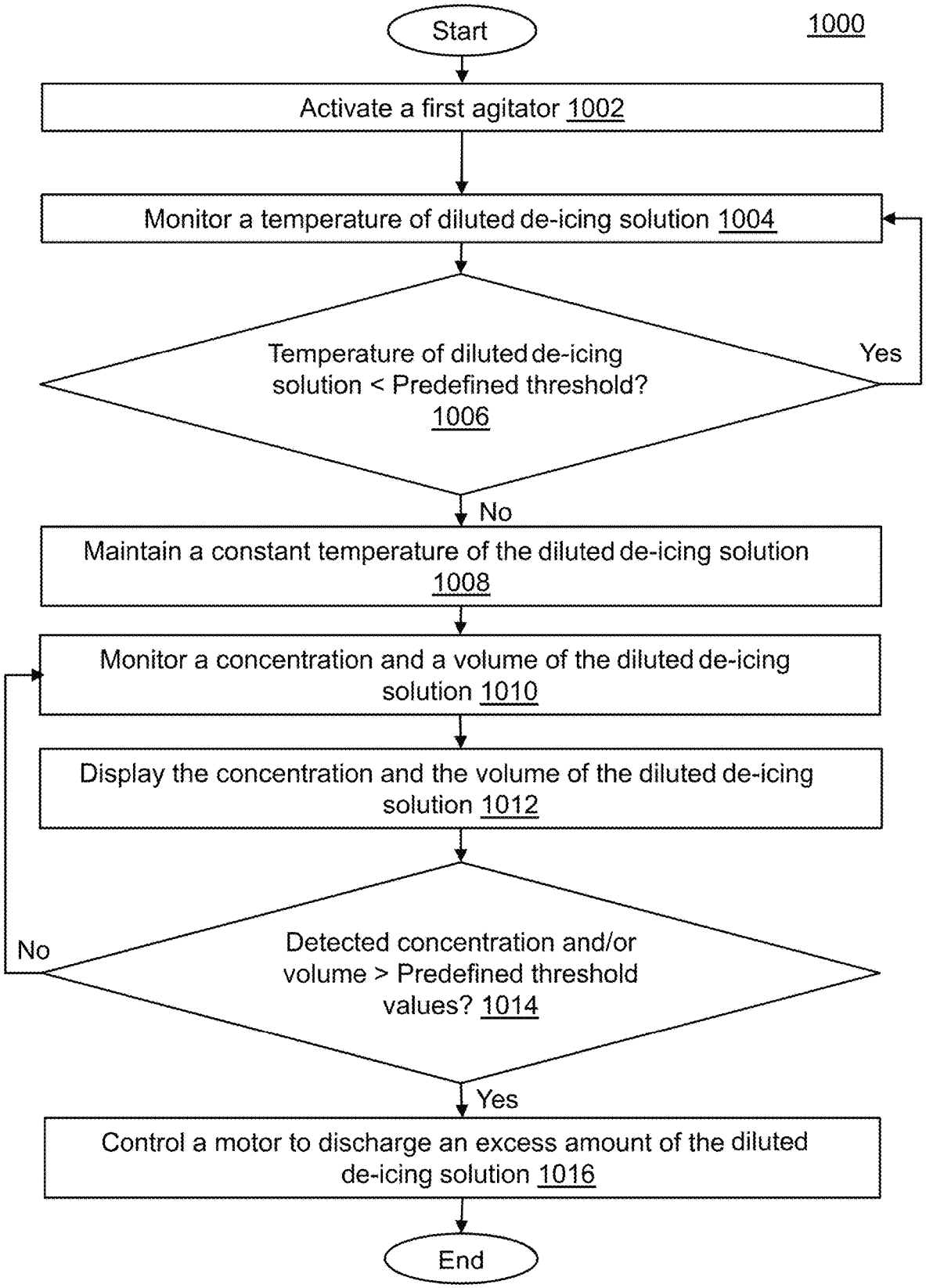
FIG. 10 illustrates a method for operating the mobile snow processing and de-icing device using the controller, according to embodiments of the present invention disclosed herein.

FIG. 10 illustrates a method 1000 for operating the device 100 using the controller 166, according to embodiments of the present invention disclosed herein.

At step 1002, the device 100 may activate the first agitator 140 positioned within the de-icing tank 134 to maintain the homogeneity of the prestored de-icing solution and/or the diluted de-icing solution at all times.

At step 1004, the device 100 may monitor the temperature of the diluted de-icing solution within the de-icing tank 134.

At step 1006, the device 100 may compare the temperature of the diluted de-icing solution with the predefined threshold. If the temperature of the diluted de-icing solution drops below the predefined threshold, then the method 1000 may return to the step 1004. Otherwise, the method 1000 may proceed further to a step 1008.

At the step 1008, the device 100 may maintain the constant temperature of the diluted de-icing solution within the de-icing tank 134 by using the heated wires 138.

At step 1010 the device 100 may further monitor the concentration and the volume of the diluted de-icing solution in the de-icing tank 134 using the first sensor 142.

At step 1012, the device 100 may display the detected concentration and the detected volume of the diluted de-icing solution on the display unit 170 to the operator.

At step 1014, the device 100 may compare the detected concentration and volume with the predefined threshold values. Upon comparison, if the detected concentration or volume exceeds the predefined threshold values, then the method 1000 may proceed to a step 1016. Otherwise, the method 1000 may return to the step 1012.

At the step 1016, the device 100 may control the motor 172 to discharge the excess amount of the diluted de-icing solution through the discharging part 144 of the de-icing tank 134.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to a mobile snow processing and de-icing device. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A mobile snow processing and de-icing device, the device comprising:

a collecting unit comprising:

one or more cylindrical brushes to scrape off snow from a surface;

a plurality of circular brushes rotatable perpendicular to the surface adapted to scrape off the snow, wherein the plurality of circular brushes are attached on the sides of the one or more cylindrical brushes; and at least one turbo-suction sweeper configured to sweep the scraped off snow from the surface using one or more turbo-suction motors through at least one collecting tube;

a de-icing unit comprising:

a heated metal grid arranged at an inlet of at least one de-icing tank to convert the collected snow into a slush; and the at least one de-icing tank, connected at an output end of the at least one collecting tube, to receive the slush and further mix the received slush with a prestored de-icing solution to prepare a diluted de-icing solution within the at least one de-icing tank; and a sprinkler unit comprising:

at least one sprinkler system, connected to an outlet of the at least one deicing tank, configured to spray the diluted de-icing solution from the at least one de-icing tank back on the surface.

2. The device of claim 1, further comprising a plurality of heated wires, installed within the at least one de-icing tank, to prevent freezing of the diluted de-icing solution in the at least one de-icing tank.

3. The device of claim 1, further comprising at least one actuator for controlling a speed of rotation of the one or more cylindrical brushes and the plurality of circular brushes.

4. The device of claim 1, further comprising at least one first agitator, installed within the at least one de-icing tank, to maintain a homogeneity of the diluted de-icing solution.

5. The device of claim 1, further comprising at least one storage tank to store a concentrated de-icing solution to ensure proper concentration of the diluted deicing solution within the at least one de-icing tank.

6. The device of claim 5, further comprising at least one second agitator to maintain a homogeneity of the concentrated de-icing solution stored in the at least one storage tank.

7. The device of claim 1, further comprising at least one helical screw housed within the at least one collecting tube to aid a propagation of the collected snow into the at least one de-icing tank.

8. The device of claim 1, wherein the one or more turbo-suction motors are adapted to adjust a speed of the at least one turbo-suction sweeper based on a density of the collected snow.

9. The device of claim 1, wherein the sprinkler system comprises a plurality of sprinkle heads for spraying the diluted de-icing solution on cleared surfaces.

10. The device of claim 9, wherein the plurality of sprinkler heads are equally distributed and aligned on a horizontal tube.

11. A snow processing and de-icing device comprising:

a collecting unit comprising:

one or more cylindrical brushes to scrape off snow from a surface;

a plurality of circular brushes rotatable perpendicular to the surface adapted to scrape off the snow, wherein the plurality of circular brushes are attached on the sides of the one or more cylindrical brushes; and at least one turbo-suction sweeper configured to sweep the scraped off snow from the surface using one or more turbo-suction motors through at least one collecting tube;

a de-icing unit comprising:

a heated metal grid arranged at an inlet of the at least one de-icing tank to convert the collected snow into a slush; and the at least one de-icing tank, connected at an output end of the at least one collecting tube, to receive the slush and further mix the received slush with prestored de-icing solution to prepare a diluted de-icing solution within the at least one de-icing tank; and a sprinkler unit comprising:

at least one sprinkler system, connected to an outlet of the at least one deicing tank, configured to spray the diluted de-icing solution from the at least one de-icing tank back on the surface; and at least one storage tank to store a concentrated de-icing solution to ensure a proper concentration of the diluted de-icing solution within the at least one de-icing tank.

12. The device of claim 11, further comprising:

a first sensor arranged within the at least one de-icing tank for detecting a concentration and a volume of the diluted de-icing solution in the at least one deicing tank; and at least one controller connected to the first sensor, wherein the at least one controller is configured to:

receive the detected concentration and the detected volume of the diluted de-icing solution from the first sensor;

display the received concentration and the detected volume of the diluted de-icing solution on a display unit to an operator;

compare the received concentration and the received volume with a set threshold values; and enable at least one motor to discharge an excess amount of the diluted de-icing solution through a discharging part of the at least one de-icing tank to prevent overflow when any of the received concentration or the received volume of the diluted de-icing solution exceeds the set threshold values.

13. The device of claim 11, further comprising a second sensor, arranged within the at least one storage tank, to measure a concentration and a volume of a concentrated de-icing solution stored in the at least one storage tank.

14. The device of claim 12, further comprising a weather sensor connected to the at least one controller for regulating a temperature of the de-icing solution based on external weather conditions.

15. The device of claim 12, further comprising at least one power supply unit for providing an operational power to the at least one controller.

16. The device of claim 11, further comprising one or more helical screws housed within the at least one collecting tube to aid a propagation of the collected snow into the at least one de-icing tank.

17. The device of claim 11, wherein the sprinkler system comprises a plurality of sprinkle heads for spraying the diluted de-icing solution on cleared surfaces.

18. A method for processing snow and de-icing using a mobile device, the method comprising:

scraping off snow from a surface using one or more cylindrical brushes and a plurality of circular brushes that are attached perpendicular on the device to the surface;

sweeping the scraped off snow from the surface using at least one turbo-suction sweeper equipped with one or more turbo-suction motors and at least one collecting tube;

converting the collected snow into a slush by using at least one heated metal grid arranged at an inlet of at least one de-icing tank;

mixing the slush with a prestored de-icing solution to produce a diluted deicing solution within the at least one de-icing tank; and spraying the diluted de-icing solution from the at least one de-icing tank back onto the surface.

19. The method of claim 18, comprising a step of controlling a speed of the plurality of circular brushes and the one or more cylindrical brushes based on a rate of snow and/or accumulation on the surface.

20. The method of claim 18, comprising storing a concentrated de-icing solution into at least one storage tank to ensure proper concentration of the diluted de-icing solution within the at least one de-icing tank.

* * * * *